US008517568B2

(12) United States Patent
Wu

(10) Patent No.: US 8,517,568 B2
(45) Date of Patent: Aug. 27, 2013

(54) EMBEDDED TYPE LAMP WITH HEAT RADIATING DEVICE

(76) Inventor: Liangju Wu, Foshan (CN)

( * ) Notice: Subject to any disclaimer, the term of this patent is extended or adjusted under 35 U.S.C. 154(b) by 428 days.

(21) Appl. No.: 12/747,701

(22) PCT Filed: Dec. 10, 2008

(86) PCT No.: PCT/CN2008/001987

§ 371 (c)(1),
(2), (4) Date: Jun. 11, 2010

(87) PCT Pub. No.: WO2009/086732

PCT Pub. Date: Jul. 16, 2009

(65) Prior Publication Data

US 2010/0265718 A1 Oct. 21, 2010

(30) Foreign Application Priority Data

Dec. 11, 2007 (CN) ..... 2007 2 0061290 U

(51) Int. Cl.
*F21V 29/00* (2006.01)
*F21V 15/00* (2006.01)

(52) U.S. Cl.
USPC ..... 362/294; 362/147; 362/364; 362/365; 362/295; 362/395

(58) Field of Classification Search
USPC ..... 362/147, 294, 373, 364, 365, 366, 362/295, 395
See application file for complete search history.

(56) References Cited

U.S. PATENT DOCUMENTS

2008/0170404 A1 * 7/2008 Steer et al. ..... 362/365
2009/0290343 A1 * 11/2009 Brown et al. ..... 362/235

FOREIGN PATENT DOCUMENTS

| | | |
|---|---|---|
| CN | 1641262 | 7/2005 |
| CN | 1676178 | 10/2005 |
| CN | 1969146 | 5/2007 |
| CN | 201149181 | 11/2008 |
| EP | 1726873 | 11/2006 |
| JP | 200680044 | 3/2006 |

* cited by examiner

*Primary Examiner* — Stephen F Husar
*Assistant Examiner* — James Cranson, Jr.
(74) *Attorney, Agent, or Firm* — Belles Katz LLC

(57) ABSTRACT

A recessed type lamp with a radiant heat device (3), comprises a lamp shade body (1), a lamp body (2) installed in the lamp shade body (1), and a radiant heat device (3) connected with the lamp shade body (1). A flame-proof expansion piece (4) preventing the radiant heat device (3) from being damaged by the flame is installed between the radiant heat device (3) and the lamp shade body (1) and/or in the lamp shade body (1) and/or in the radiant heat device (3).

20 Claims, 6 Drawing Sheets

EMBEDDED TYPE LAMP WITH HEAT RADIATING DEVICE

CROSS-REFERENCE TO RELATED PATENT APPLICATIONS

The present application is a U.S. national stage application under 35 U.S.C. §371 of PCT Application No. PCT/CN2008/001987, filed Dec. 10, 2008, which claims priority to Chinese Application No. 200720061290.6, filed Dec. 11, 2007, the entireties of which are incorporated herein by reference.

TECHNOLOGY CATEGORY

This invention involves a type of lamp; in particular a recessed type lamp with radiant heat device.

Figure 1:
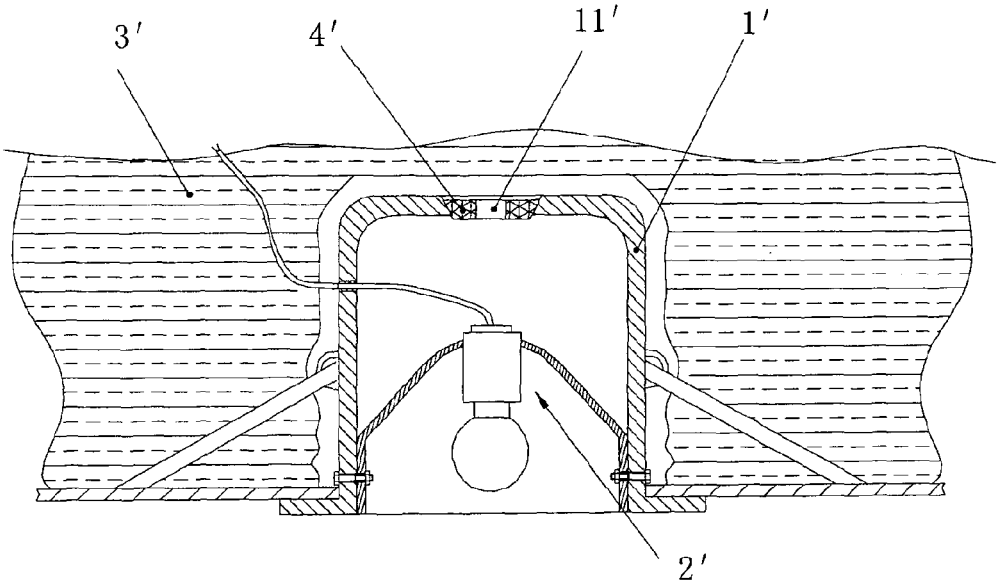

In modern interior design, people often install recessed lamps into walls or ceilings, including suspended ceilings and walls of cabinets etc. To prevent the spreading of flames should fire occur, the aforementioned ceilings and wall pieces utilize flame-proof materials. However, drilling holes in these surfaces is required when recessed lamps are installed. This in turn requires the installed recessed lamps themselves to have the function to prevent fire from spreading. Currently, most recessed lamps with flame-proof functionality usually incorporate heat dissipation or ventilation holes directly opening on the lamp shade body. As shown in FIG. 1, the lamp's body (2') is installed within the lamp shade body (1'), and the lamp shade body has the heat dissipating holes (11'). Flame-proof expansion material (4') is installed near the holes. When fire occurs, the expansion material will expand to gradually close the heat dissipation holes on the lamp. While this structure is relatively simple, it possesses substantial disadvantages: firstly, at the start of a fire, when the expansion materials have not yet covered the entire heat dissipation holes, flames can easily escape from these partially closed holes into the ceilings or walls, and set ablaze the flammable materials within, spreading the fire even wider. Secondly, in order to fully dissipate heat, lamp shade bodies usually are made with multiple heat dissipation holes. These holes reduce the soundproofing effect, and cannot fully satisfy the soundproofing requirements of the architectural laws (e.g. UK Building Acts Part E Acoustic Rating); more importantly, these heat dissipation holes directly dissipate high-temperature currents, leading to fire security risks as well as causing problems for the lamps in temperature rise tests. For example, the tests for EU recessed lamp temperature rise standard in EN60598-1, clause 12.4 and EN 60598-2-2, clause 2.12 require that "recessed lamp cannot have an exceedingly high temperature, to prevent any danger of fire from happening", "when carrying out temperature rise test under normal operation, any part of the recessed testing box cannot exceed 90 degrees Celsius." However, current heat dissipation holes release air currents far hotter than 90 degrees Celsius, Moreover, indoor warm air during winter or indoor cool air during summer will escape outdoors through these heat dissipation holes, causing waste and greatly increasing the energy consumption in air-conditioning, affecting indoor temperature control, and thus fail to fulfil the requirements of architectural laws (e.g. UK Building Act Part C Air Tightness). In addition, to reduce energy consumption and to maintain temperature and insulate heat of the building, there are also requirements to install a certain thickness of insulating materials around the lamp (3') (the insulating material can be glass fibre material rockwool fibre material, ceramic fibre material etc.), in this situation, heat dissipation holes can easily be covered or sealed by insulating materials during insulation, leading to no air convection, which in turn causes poor heat dissipation within the lamp, building up towards internal overheating, and in a less severe case leads to burnt light bulbs or cable, or in a more severe case can cause short circuit and subsequent fire risks.

Figure 2:
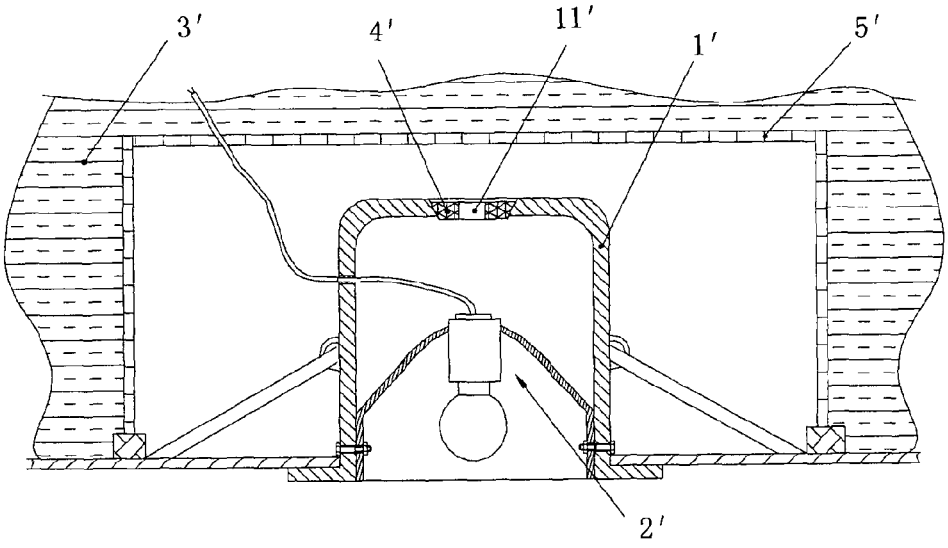

To fulfil the heat dissipation requirements for lamps in a poor heat dissipation environment, people devised a hollow body based on previous recessed flame-proof lamps, as shown in FIG. 2. That is after the flame-proof lamp has been installed, the hollow body (5') covers the top of the flame-proof lamp, providing an inner cavity for air convection inside the lamp to dissipate heat. However, such a structure usually requires a hollow metal body which results in higher production costs as well as complex installation procedures. A recessed type lamp with a radiant heat device can effectively resolve the heat dissipation problem, with its structure of linking the radiant heat device on the top of the lamp shade body. To reduce production costs and ensure the heat dissipation effects, the radiant heat device is usually made of aluminium. Quite often, lamp shade bodies are of open structure, which cannot comply with flame-proof requirements. Even if the lamp shade body is designed to be sealed, because of the relatively low melting point of aluminium, when fire occurs, flames entering the lamp shade body can easily cause the radiant heat device to melt, and allow flames to spread towards the back of the flame-proof boards where the lamp was installed.

Therefore, providing a structurally simple, low cost with effective heat dissipation function and high quality flame-proof recessed type lamp is of utmost importance.

INVENTION DETAILS

This invention aims to provide a recessed type lamp with radiant heat device, which can still dissipate heat from the lamp when exposed to air or enclosed by insulating materials, as well as, when fire breaks cut, prevent the radiant heat device from causing damage to the device itself or the fire from spreading through the radiant heat device itself, or the gaps at the connection point of the radiant heat device and the lamp shade body, damaging the flame-proof capability of the flame-proof installation panel.

This invention utilizes the following technology to solve the technical problem:

The aforementioned recessed type lamp with radiant heat device includes a lamp shade body, a lamp body within the lamp shape body, a radiant heat device connected with the lamp shade body as well as a flame-proof expansion piece that can prevent the radiant heat device from fire damage installed between the radiant heat device and/or within the lamp shade body and/or within the radiant heat device.

The radiant heat device can be installed on top of the lamp shade body, and the flame-proof expansion device can be installed between the top outer surface of the lamp shade body and the radiant heat device, or on the inner surface at the top of the lamp shade body, or on the inner side surface near the top of the lamp shade body. The aforementioned radiant heat device is of sealed structure.

The radiant heat device can be as an integral structure with the lamp shade body, which means the top of the lamp shade body is the radiant heat device itself. In this situation, the flame-proof expansion piece can be installed at the bottom of the radiant heat device or on the inner side surface of the lamp shade body, near the radiant heat device.

There is also another technical solution: install brackets inside the lamp shade body, and fix the flame-proof expansion piece on them.

The radiant heat device can be set up with a heat conducting column, which passes into the lamp shade body, and the flame-proof expansion pieces are installed inside the lamp shade body, which surround the heat-conducting column.

When comparing this invention to current existing technology, the advantages of this invention are:

This invention, with the lamp shade body and radiant heat device forming a substantially sealed structure, prevents indoor cold currents or warm currents from escaping, reducing energy consumption, as well as reinforcing the temperature control and heat-insulation effect of the building. Also the heat air generated by the lamp convects with surrounding air passing over the radiant heat device, thus preventing overheated air currents from directly escaping and reducing the associated security risks. This also meets the requirements of the temperature rise test for lamps, such as the temperature rise test based on the EU recessed lamp standard EN60598-1, clause 12.4 and EN60598-2-2, clause 2.12, When fire breaks out, even if flames pass through the gap between the lamp body, and usually the metal made lamp shade body will quickly be heated up, the flame-proof expansion piece installed between the radiant heat device will expand quickly, forming a thick, flame-proof, heat-insulated protection layer, preventing the radiant heat device from overheating and causing damage by the flames within the lamp shade body or the lamp shade body itself at the bottom. In this situation, flames cannot pass through the damaged radiant heat device itself or gaps created at the connection between the damaged radiant heat device and the lamp shade body spreading to the back of the installation flame-proof panels and causing damage to the boards, which affects their flame-proof functionality In addition, adding a cover over the radiant heat device can create a certain amount of heat dissipation space at the top of and around the radiant heat device, preventing the lamp from being enclosed by surrounding insulating materials, which results in hampered heat dissipation functionality.

EXPLANATIONS OF FIGURES

The following, together with the figures, provides further explanations to this invention.

Figure 3:
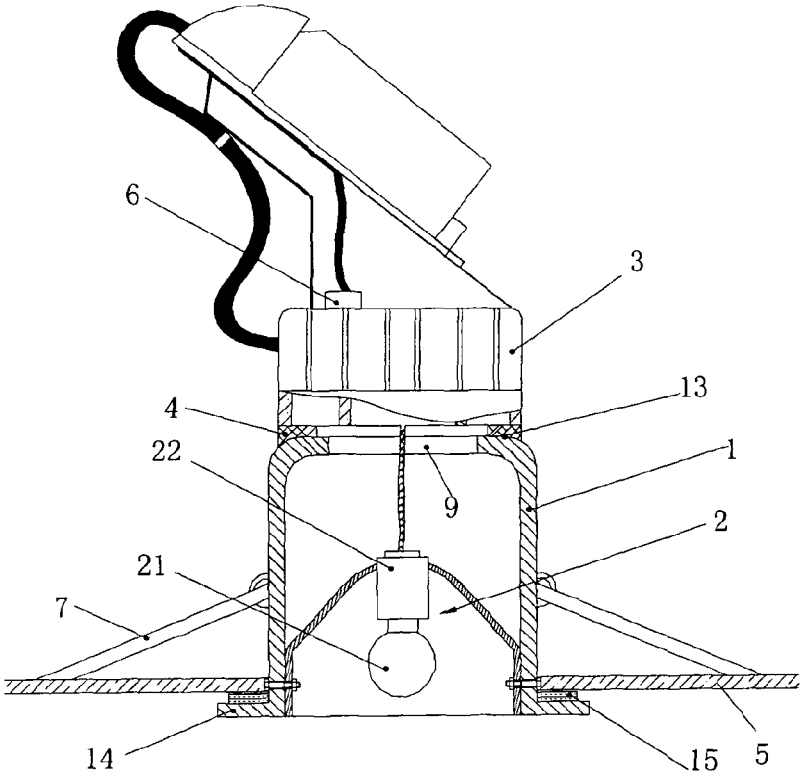
Figure 4:
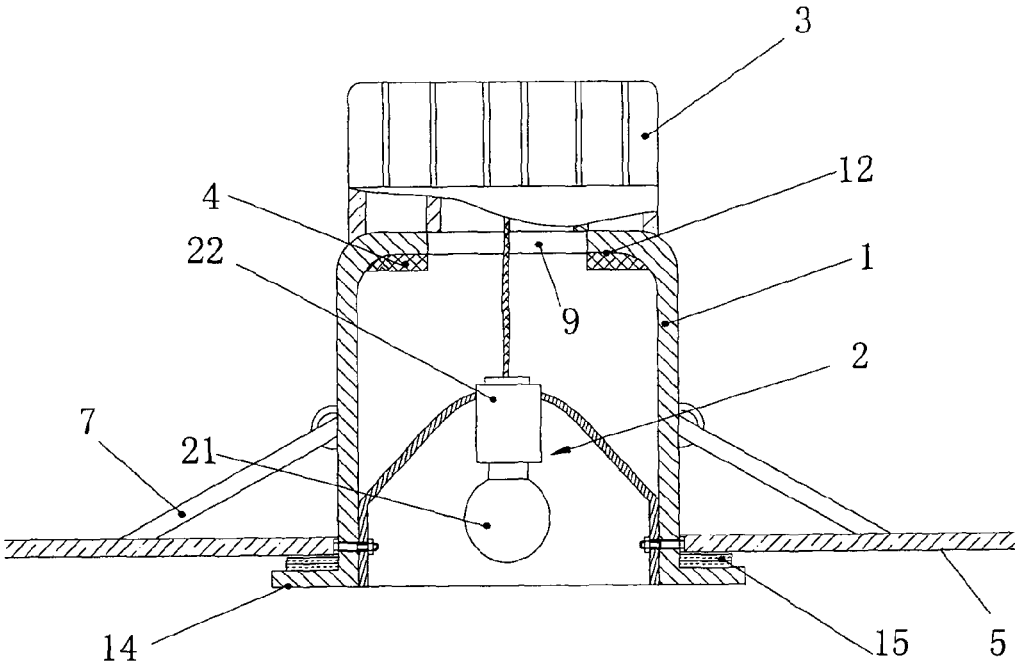
Figure 5:
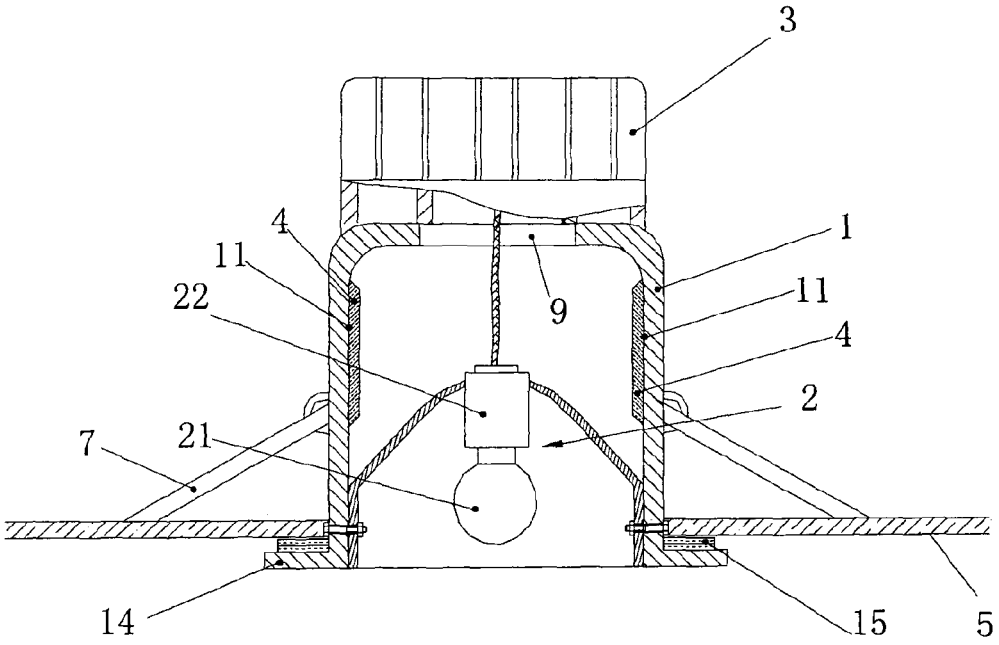
Figure 6:
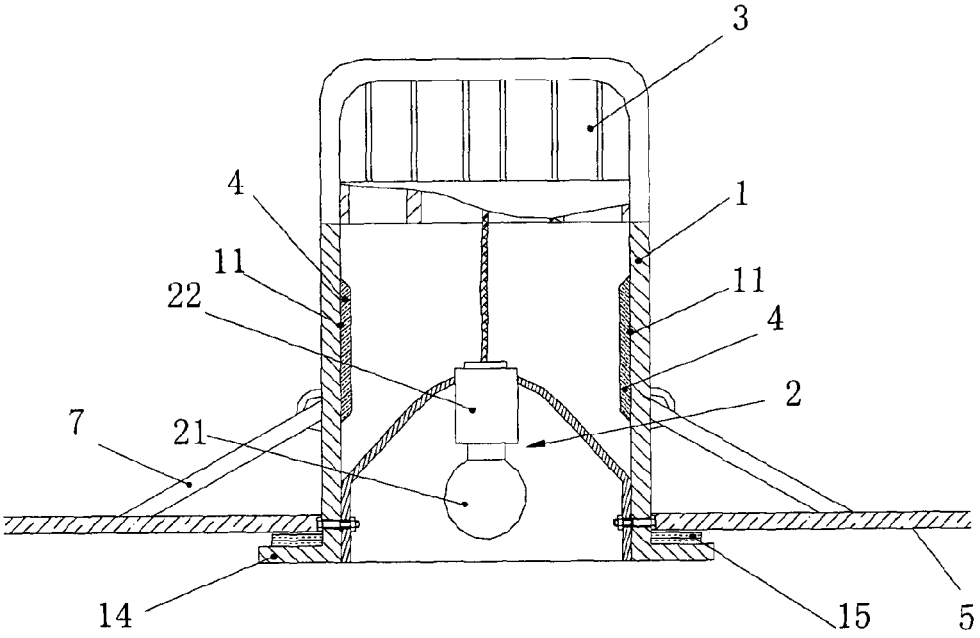
Figure 7:
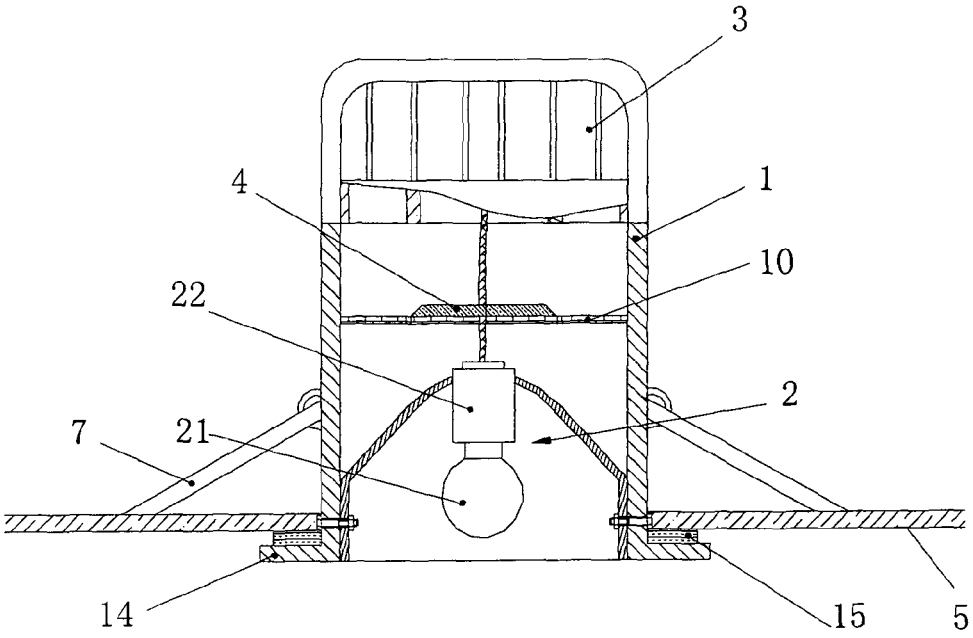
Figure 8:
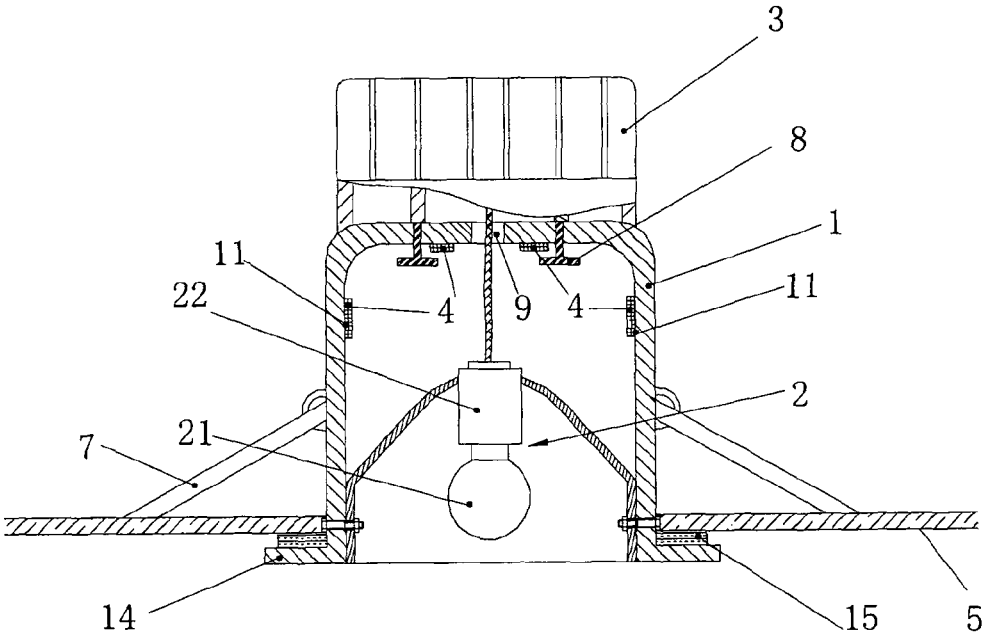
Figure 9:
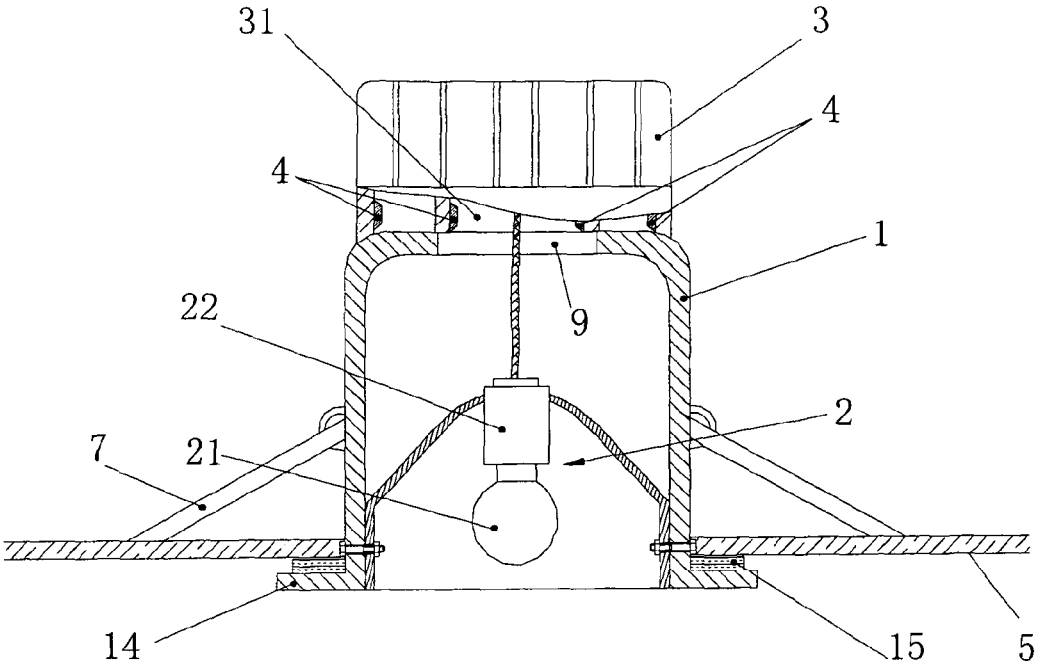
Figure 10:
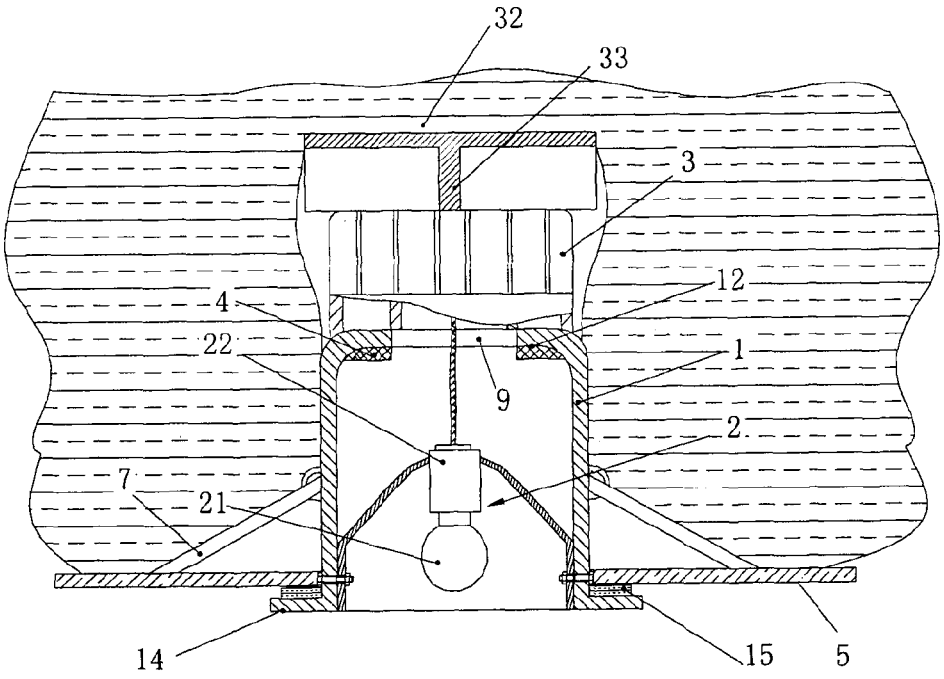
Figure 11:
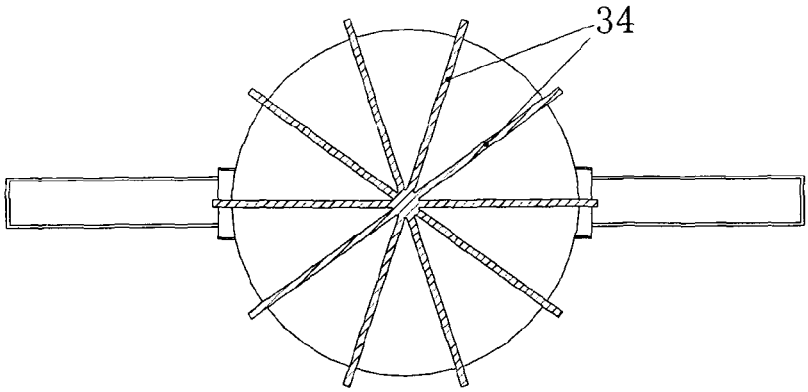

1: FIG. 1 is a structural diagram of the current recessed type flame-proof lamp, 2: FIG. 2 is a structural diagram of the current flame-proof lamp with empty chamber, 3: FIG. 3 is a structural diagram of the first type of implementation example of this invention, 4: FIG. 4 is a structural diagram of the second type of implementation example of this invention, 5: FIG. 5 is a structural diagram of the third type of implementation example of this invention, 6: FIG. 6 is a structural diagram of the fourth type of implementation example of this invention, 7: FIG. 7 is a structural diagram of the fifth type of implementation example of this invention, 8: FIG. 8 is a structural diagram of the sixth type of implementation example of this invention, 9: FIG. 9 is a structural diagram of the seventh type of implementation example of this invention, 10: FIG. 10 is a structural diagram of the eighth type of implementation example of this invention, 11: FIG. 11 is a vertical view of the eighth type of implementation example of this invention.

PRACTICAL IMPLEMENTATION METHODS

Implementation Example One

As shown in FIG. 3, a recessed type lamp of this implementation example with radiant heat device includes lamp shade body (1) installed with spring clip (7), which is used to set the lamp on the installation panel (5). The lamp shade body (1) also has an opening (9) on its top. The lamp body (2) is installed inside the lamp shade body (1), and consists of a light source (21) and a lamp base (22) (the lamp body (2) can also be a LED lamp, and lamp base (22) can also be a circuit board). The lamp base is installed in the lamp shade body (1), with a light source (21) installed within the lamp base. Similarly, the lamp body (2) can also include multiple light sources: such sources can be installed on one or more lamp bases, The radiant heat device (3) is installed on the lamp shade body (1) by bolts or clips. This implementation example utilizes the structure of connecting the radiant heat device to the top of the lamp shade body. To protect the radiant heat device from fire damages, a flame-proof expansion piece (4) can also be installed between the radiant heat device (3) and the lamp shade body (1), or on the top of the lamp shade body's (1) outer surface. In this implementation example, the flame-proof expansion piece (4) is installed on the top of the lamp shade body (1) between its outer surface (13) and the radiant heat device (3). Of course, the disposition of the flame-proof expansion piece (4) will not affect the heat dissipation of the lamp. The lamp shade body's (1) opening has a folded edge (14); a flame-proof shim (15) is disposed on the folded edge, or is disposed between folded edge (14) and installation panel (5), which for example can be between the ceilings. This can prevent fire from going through the gap between the lamp and the installation panel to spread backwards. The flame-proof expansion piece (4) and the flame-proof shim (15) used in this implementation example are made from highly expandable flame-proof materials, and can expand up to tens or even hundreds of times of its size quickly upon heat, forming a thick layer of carbides, which provides good flame-proof and heat insulation functionality. Even in a normal work environment, this flame-proof expansion material can insulate heat from the radiant heat device and stop heat from conducting into the heat radiant heat device under high temperature to effectively meet the temperature requirements of the lamp surroundings. The radiant heat device (3) uses a finned structure on its surface that can assist the heat dissipation of the device. The lamp's circuit is also installed with a temperature control device, in which a temperature detection piece (6) is fixed on the radiant heat device (3). Once the temperature exceeds its set value, the temperature control device can set the lamp circuit to break, thus safeguarding the lamp and preventing any cause of fire risks. This implementation example not only preserves good heat dissipation capability, passing tests to meet the requirements to install certain thickness of heat-insulating materials (3') around the lamp (the insulating material can be glass fibre material, rockwool fibre material, ceramic fibre material etc.), but also during a fire, the implementation can satisfy the need to protect the radiant heat device and prevent flames from spreading to the lamp or the back of the installation panel through the gaps of the damaged radiant heat device, Should there be functional requirements that lead to for example a pass-through for the connection cable of electrical devices, or the opening of certain gaps, the flame-proof expansion piece, upon fire, can quickly expand and seal these functional gaps, thus preventing the spreading of fire from the lamp in such situations.

Implementation Example Two

As shown in FIG. 4, a recessed type lamp of this implementation example with radiant heat device includes its flame-proof expansion piece (4) disposed on the inner surface (12) on the top of the lamp shade body (1). Such flame-proof expansion piece, when exposed to fire, will be heated up and expand very quickly, which will fill in the space within the lamp shade body near the radiant heat device, forming a thick, flame-proof and heat-insulating protection layer inside the lamp shade body below the radiant heat device, preventing the radiant heat device from damage by the heat conducted from the lamp shade body and the fire inside it at the bottom, as well as insulating the heat to prevent it from passing through the lamp shade body or the radiant heat device to the surroundings, causing a spread of damages. All the other structures of this implementation example are the same as the first implementation example.

Implementation Example Three shown in FIG. 5, a recessed type lamp of this implementation example with radiant heat device includes its flame-proof expansion piece (4) installed on the inner side surface (11), near the top of the lamp shade body (1). Such flame-proof expansion piece, when exposed to fire, will be heated up and expand very quickly, which will fill in the space within the lamp shade body near the radiant heat device, forming a thick, flame-proof and heat-insulating protection layer inside the lamp shade body below the radiant heat device to prevent the radiant heat device from damage by the heat conducted from the lamp shade body and the fire inside it at the bottom, as well as insulating the heat to prevent it from passing through the lamp shade body and the radiant heat device to the surroundings, causing a spread of damage. All the other structures of this implementation example are the same as the first implementation example.

Implementation Example Four

As shown in FIG. 6, a recessed type lamp of this implementation example with radiant heat device includes a lamp body (2) installed within the lamp shade body (1), and the lamp shade body (1) together with the radiant heat device working as an integral structure, which means the top of the lamp shade body (1) is the radiant heat device (3). The flame-proof expansion piece (4) is installed below the radiant heat device (3) or the inner side surface (11) of lamp shade body (1), near the radiant heat device (3). Thus the flame-proof expansion piece, when exposed to fire, will be heated up and expand quickly, forming a thick, flame-proof and heat-insulating protection layer inside the lamp shade body and below the radiant heat device.

Implementation Example Five

As shown in FIG. 7, a recessed type lamp of this implementation example with radiant heat device has its lamp body (2) installed within the lamp shade body (1), and within the lamp shade body (1) a bracket is installed (10). The flame-proof expansion piece (4) is fixed on the bracket (10). Thus the flame-proof expansion piece, when exposed to fire, will be heated up and expand very quickly, forming a thick, flame-proof and heat-insulating protection layer inside the lamp shade body and below the radiant heat device. Furthermore, the support of the bracket protects the layer from peeling off, resulting in the loss of protection.

Implementation Example Six

As shown in FIG. 8, a recessed type lamp of this implementation example with radiant heat device includes the lamp shade body (1), a the lamp body (2), which is installed inside the lamp shade body (1), a radiant heat device (3), which is fixed on the top of the lamp shade body (1) within the heat conducting column (8). A flame-proof expansion piece (4) is installed within the lamp shade body (1) surrounds the heat conducting column (8). The flame-proof expansion piece, when exposed to fire, will be heated up and expand very quickly, forming a thick, flame-proof and heat-insulating protection layer inside the lamp shade body below the radiant heat device. This protection layer at the same time also encloses the heat conducting column preventing it from conducting heat.

Implementation Example Seven

As shown in FIG. 9, to improve the heat dissipation efficiency of the radiant heat device, the radiant heat device (3) can be designed to include a central cavity (31). In this way, the flame-proof expansion piece (4) can be installed near the lamp shade body (1) within the cavity (31). When the flame-proof expansion piece (4) heats up after exposing to fire, it will quickly expand inside the cavity (31) forming a thick, flame-proof and heat-insulated protection layer near the lamp shade body area (1). This protection layer can also protect the radiant heat device and the lamp from damages during a fire.

The radiant heat device (3) mentioned above, can be designed as a sealed structure, which means the radiant heat device (3) itself is sealed, or will become sealed upon contacting with the flame-proof expansion piece (4) at the bottom or collaborating with the top of the lamp shade body (1). In this way, the lamp can dissipate heat by the radiant heat device, as well as meet the requirements of certain architectural laws. For example, the air leaks, air-tightness and sound-proofing requirements of the UK Building Act.

Implementation Example Eight

As shown in FIGS. 10 and 11, implementation example eight is built upon the previous examples. A cover (32) is added on top of the radiant heat device (3). The cover (32) is of umbrella shape and includes a support (33) and radiating backbones or fins (34). The cover (32) also has a larger diameter than the lamp, so as to preserve convection space on top of and around the radiant heat device (3), as well as preventing any non-conducting materials in the environment from enclosing the radiant heat device and reducing its heat dissipation effect. The cover can also take other forms, such as a canopy form with multiple supports, a grid support structure, or utilizing flaps or flaps with holes etc.

The invention claimed is:

1. A recessed type lamp comprising:

a lamp shade body;

a lamp body installed in the lamp shade body;

a radiant heat device connected to the lamp shade body; and a flame-proof expansion piece preventing the radiant heat device from being damaged by fire.

2. A recessed type lamp according to claim 1 wherein the flame-proof expansion piece is installed in the radiant heat device.

3. A recessed type lamp according to claim 1 wherein the flame-proof expansion piece is installed inside the lamp shade body.

4. A recessed type lamp according to claim 1 wherein the flame-proof expansion piece is installed between the radiant heat device and the lamp shade body.

5. A recessed type lamp according to claim 1 wherein the radiant heat device is installed on top of the lamp shade body and the flame-proof expansion piece is installed between an outer surface of the top of the lamp shade body and the radiant heat device.

6. A recessed type lamp according to claim 1 wherein the radiant heat device is installed on top of the lamp shade body and the flame-proof expansion piece is installed on an inner surface of the top of the lamp shade body.

7. A recessed type lamp according to claim 1 wherein the radiant heat device is installed on top of the lamp shade body, and the flame-proof expansion piece is installed on an inner side surface near the top of the lamp shade body.

8. A recessed type lamp according to claim 1 that further comprises a bracket disposed inside the lamp shade body and the flame-proof expansion piece is fixed on the bracket.

9. A recessed type lamp according to claim 1 in which the radiant heat device has a heat conduction column installed within the lamp shade body.

10. A recessed type lamp according to claim 1, wherein the radiant heat device is of sealed construction.

11. A recessed type lamp according to claim 1 wherein the lamp body is spaced from a top inner surface of the lamp shade body.

12. A recessed type lamp according to claim 1 wherein the lamp comprises a circuit and further comprising a temperature-control device installed in the lamp's circuit and a temperature detection piece fixed on the radiant heat device.

13. The recessed type lamp according to claim 1 wherein the radiant heat device and the lamp shade body are separate and distinct components, the radiant heat device connected to a top surface of the lamp shade body.

14. A recessed type lamp with a radiant heat device comprising:

a lamp shade body;

a lamp body installed in the lamp shade body;

a flame-proof expansion piece preventing the radiant heat device from being damaged by fire; and wherein the radiant heat device and the lamp shade body are an integral structure, and wherein a top of the lamp shade body serves as the radiant heat device and the flame-proof expansion piece is installed at one of (i) a bottom of the radiant heat device; or (ii) an inner side surface of the lamp shade body near the radiant heat device.

15. A recessed type lamp comprising:

(i) a lamp shade body;

(ii) a lamp body installed inside the lamp shade body; and (iii) a radiant heat device; and wherein the lamp shade body and the radiant heat device form a substantially sealed structure devoid of heat dissipation holes; and wherein the radiant heat device comprises fins.

16. A recessed type lamp according to claim 15 wherein a flame-proof expansion piece is installed between the radiant heat device and the lamp shade body.

17. A recessed type lamp according to claim 15 wherein a flame-proof expansion piece is installed within a cavity in the radiant heat device.

18. A recessed type lamp according to claim 15 wherein a flame-proof expansion piece is installed inside the lamp body.

19. A recessed type lamp according to claim 15 wherein the radiant heat device is installed on top of the lamp shade body.

20. A recessed type lamp comprising:

(i) a lamp shade body;

(ii) a lamp body;

(iii) a radiant heat device; and (iv) a flame-proof expansion piece; and wherein the radiant heat device is installed on top of the lamp shade body and the flame-proof expansion piece is installed between an outer surface of the top of the lamp shade body and the radiant heat device.

* * * * *